US009795827B2

(12) United States Patent
Wiener et al.

(10) Patent No.: US 9,795,827 B2
(45) Date of Patent: Oct. 24, 2017

(54) RETRACTABLE TREADMILL DESK

(71) Applicant: Thermogenesis Group, Inc., Bellevue, WA (US)

(72) Inventors: Ron Wiener, Mercer Island, WA (US); Andrew Rosenbaum, Mercer Island, WA (US); Cole Dalton, Snohomish, WA (US)

(73) Assignee: Thermogenesis Group, Inc., Bellevue, WA (US)

( * ) Notice: Subject to any disclaimer, the term of this patent is extended or adjusted under 35 U.S.C. 154(b) by 0 days.

(21) Appl. No.: 14/851,126

(22) Filed: Sep. 11, 2015

(65) Prior Publication Data

US 2016/0074701 A1 Mar. 17, 2016

Related U.S. Application Data

(60) Provisional application No. 62/049,938, filed on Sep. 12, 2014.

(51) Int. Cl.

| | |
|---|---|
| ***A63B 22/02*** | (2006.01) |
| ***A63B 22/00*** | (2006.01) |
| *A63B 71/00* | (2006.01) |
| *A63B 21/00* | (2006.01) |

(52) U.S. Cl.

CPC ..... *A63B 22/02* (2013.01); *A63B 22/0023* (2013.01); *A63B 22/0235* (2013.01); *A47B 2220/06* (2013.01); *A63B 21/152* (2013.01); *A63B 71/0054* (2013.01); *A63B 2071/0081* (2013.01); *A63B 2208/0204* (2013.01); *A63B 2208/0233* (2013.01); *A63B 2210/06* (2013.01); *A63B 2210/50* (2013.01); *A63B 2220/803* (2013.01); *A63B 2225/093* (2013.01)

(58) Field of Classification Search

CPC ... A63B 22/02; A63B 2210/06; A63B 21/152; A63B 22/0023; A63B 71/0054; A63B 2071/0081; A63B 2210/50; A63B 2210/56; A63B 2225/093; A47B 2220/06

USPC ..... 482/903, 910

See application file for complete search history.

(56) References Cited

U.S. PATENT DOCUMENTS

| | | | | | |
|---|---|---|---|---|---|
| 4,066,257 | A * | 1/1978 | Moller | A63B 22/02 | 482/54 |
| 5,669,857 | A * | 9/1997 | Watterson | A63B 22/0023 | 482/51 |
| 5,683,332 | A * | 11/1997 | Watterson | A63B 22/0023 | 482/51 |
| 5,702,325 | A * | 12/1997 | Watterson | A63B 22/02 | 482/51 |
| 5,704,879 | A * | 1/1998 | Watterson | A63B 22/0023 | 482/51 |
| 5,718,657 | A * | 2/1998 | Dalebout | A63B 22/0023 | 482/112 |
| 5,733,228 | A * | 3/1998 | Stevens | A63B 22/0023 | 482/51 |
| 5,743,833 | A * | 4/1998 | Watterson | A63B 22/0023 | 482/51 |
| 5,769,759 | A * | 6/1998 | Alter | A63B 22/04 | 482/37 |

(Continued)

*Primary Examiner* — Joshua Lee
(74) *Attorney, Agent, or Firm* — Sheridan Ross P.C.

(57) ABSTRACT

A retractable walking treadmill which may be connected to an adjustable-height desk, in such a way as to be able to be retracted and stowed vertically when not in use.

20 Claims, 12 Drawing Sheets

(56) References Cited

U.S. PATENT DOCUMENTS 5,813,947 A * 9/1998 Densmore ..... A63B 22/205 482/51
5,919,117 A * 7/1999 Thompson ..... A63B 22/02 198/850
6,224,516 B1 * 5/2001 Disch ..... A63B 22/02 482/51
6,231,482 B1 * 5/2001 Thompson ..... A63B 22/02 482/37
7,022,050 B2 * 4/2006 Sankrithi ..... A63B 22/0235 482/54
8,876,662 B2 * 11/2014 Hao ..... A47B 37/00 482/4
9,138,615 B2 * 9/2015 Olson ..... A63B 22/02
9,364,706 B2 * 6/2016 Lo ..... A63B 22/0015
2002/0043909 A1 * 4/2002 Nielsen ..... A47B 85/08 312/237
2003/0008751 A1 * 1/2003 Hsu ..... A63B 22/02 482/54
2004/0067821 A1 * 4/2004 Kehrbaum ..... A63B 22/02 482/54
2005/0130807 A1 * 6/2005 Cutler ..... A63B 22/0023 482/54
2006/0247109 A1 * 11/2006 Powell ..... A63B 71/0622 482/148
2007/0142175 A1 * 6/2007 Morgan ..... A63B 21/068 482/1
2008/0234111 A1 * 9/2008 Packham ..... A63B 22/02 482/54
2008/0280734 A1 * 11/2008 Dickie ..... A63B 22/0023 482/54
2009/0005224 A1 * 1/2009 Davis ..... A63B 22/02 482/54
2014/0080678 A1 * 3/2014 Wu ..... A63B 22/02 482/54
2015/0250304 A1 * 9/2015 Dalebout ..... A63B 22/02 482/54
2015/0251048 A1 * 9/2015 Dalebout ..... A63B 71/0686 482/54
2016/0074698 A1 * 3/2016 Figueroa ..... A47C 17/38 5/2.1
2016/0287930 A1 * 10/2016 Moser ..... A63B 71/0622

* cited by examiner

RETRACTABLE TREADMILL DESK

CROSS REFERENCE TO RELATED APPLICATIONS

The present application claims the benefit of and priority, under 35 U.S.C. §119(e), to U.S. Provisional Application Ser. No. 62/049,938, filed on Sep. 12, 2014, entitled "Retractable Treadmill Desk," which is hereby incorporated herein by reference in its entirety for all that it teaches and for all purposes.

BACKGROUND

Treadmill desks are rapidly becoming more commonplace in the workplace and home office. However, a major limiting factor in the adoption of treadmill desks has been the space required for the treadmill, especially when not in use. Since treadmill desks are typically only used for a few hours per day at most, a major convenience would be the ability to make the treadmill "vanish" in order to recover the floor space, and to be able to use the desk in a standing or sitting modality, at the correct ergonomic height.

"Incline" mechanisms and "folding" mechanisms are known.

Incline mechanisms vary in design, but are designed to raise the front of the treadmill to increase exertion level. None reach a position that makes the treadmill no longer functional for walking/running, hence none are designed to continue lifting the treadmill until it is stowed vertically.

Folding mechanisms hinge the treadmill at the front. There are some designs in the market that fold the desk up along with the treadmill, though this is an impractical solution as most people do not want to clear their desk of all items before stowing the treadmill. Also, this means the desk cannot be used so long as the treadmill is stowed.

DETAILED DESCRIPTION

Figure 1:
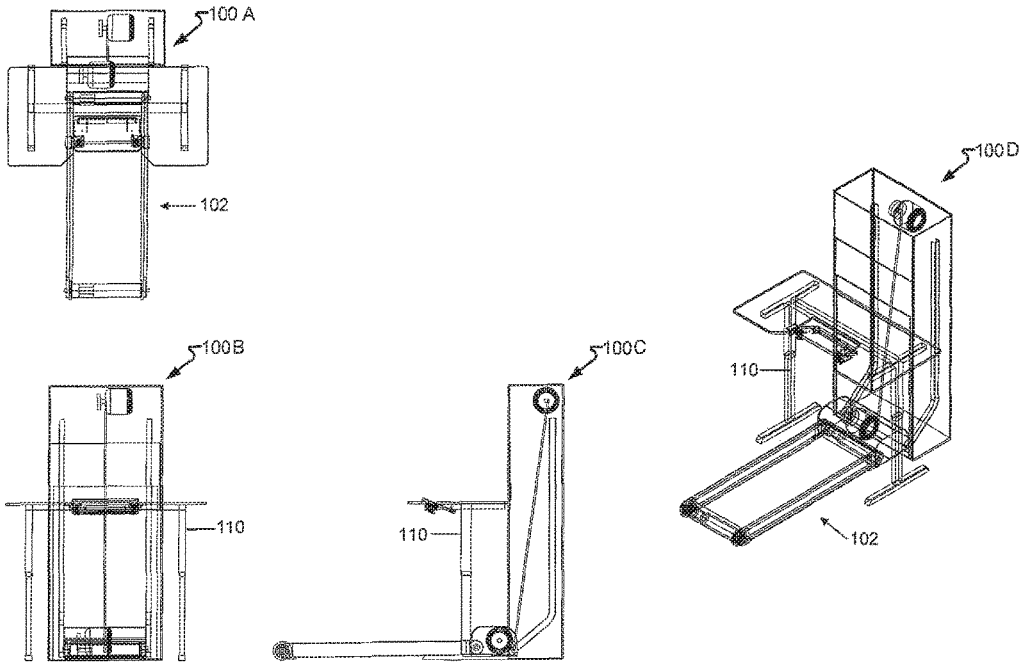
FIG. 1 illustrates multiple graphical projections of an embodiment of a retractable treadmill desk.

The disclosed retractable treadmill desk is a walking treadmill which may be connected to an adjustable-height desk, in such a way as to be able to be retracted and stowed vertically behind the desk when not in use. This can be done in a single operation when the user presses the "Retract" button, wherein the desk is automatically raised to its highest position, the treadmill is pulled up and locked into a safe vertical position behind the desk, and the desk is then lowered back down to either a standing-height or sitting-height position, per the user's preference. The disclosed retractable treadmill may be integrated with a desk or may be a stand-alone item.

Retracting the treadmill and movement of the desk may be fully automated, through user activation of a "Retract" button, or may be partially automated, such as through separate commands to move the desk and to retract the treadmill.

The desktop may incorporate a "cabinet" for the treadmill, for safety and to conceal the treadmill from view atop the desk when stowed.

The mechanism for lifting the treadmill shown in the figures includes a track and a cable connecting the motor to the treadmill. The motor can wind and unwind the cable to raise and lower the treadmill. The track keeps the treadmill aligned as it is raised and lowered so the long sides of the treadmill stay perpendicular to the front and rear edges of the desk. Other mechanisms for keeping the treadmill aligned can be devised, including mechanisms without a track.

Another aspect of the track would be a mechanism for keeping the treadmill in the track. Examples of mechanisms for that include guide wheels or glides on the treadmill portion of the guiding system riding in a channel shaped rail or other shape capable of capturing the guide wheels/glides.

Another variant of the design, in place of a single cable as shown in the figures, would have cables attached to both sides of the treadmill and those cables would be attached to both ends of an axle. The axle could then be rotated by the motor (or alternately a manual mechanism) to raise and lower the treadmill by winding and unwinding the cable on the axle. Other mechanisms for sensing and controlling the movement of the treadmill to keep it moving in the desired direction could include two motor/cable systems and sensors or encoders to detect the differential in motion of the treadmill—and automatic correction, etc. [Para. 20] Another variant of this mechanism would be use a chain mechanism instead of a track and cables.

Other lifting mechanisms besides the motor and cable can be devised. These can include springs and other linkages. Many different linkages including but are not limited to equal and unequal length paired arms (a.k.a. 4-bar linkages), single lever systems, combinations of cams, levers and so-called "geneva" mechanisms. These and other examples of kinematic linkages could be actuated with cables, as on the previous examples, or by direct or indirect acting linear actuators. Actuators could be electro-mechanical, hydraulic, pneumatic, or a combination of these. Manually driven mechanisms are also possible, utilizing human power as the prime mover. Spring-loaded mechanisms, mechanical, pressurized gas, or other typical devices could be used to support portions of the load and assist the manual, electromechanical, or other driving mechanisms which move the treadmill.

Pulley systems may also be employed to either manually or automatically raise and lower the treadmill. The pulleys may be used to provide a convenient means to manually actuate—as on some window shade or roll-up warehouse doors. Or, an actuator of some sort may be attached to the cable/chain/rope to provide automatic actuation. Push-pull ("Bowden") cables could also be used to deploy and retract, providing positive positioning throughout the entire range of motion. Pulley/gantry systems may also be used to amplify force or motion to allow for shorter stroke actuators and/or provide a more compact mechanism envelope.

A purely mechanical mechanism for lifting and lowering the treadmill may also be utilized.

Safety is a key consideration when moving the treadmill up and down. Various levels of safety can be built into these mechanisms.

One safety feature would be a mechanism to lock the treadmill into the upright position. One example of this would be an actuator that slides a restraining bar across the mechanism that allows (or prevents) the treadmill to be (or from being) lowered.

Another safety mechanism would be similar to the way an inertial reel or car seat belt mechanism works that keeps the treadmill from unwinding and sliding out of the upright position. These mechanical mechanisms operate by sensing unexpected or unallowed acceleration or deceleration events and, as a result, causes a mechanism to move into a position that locks the unwinding mechanism.

FIG. 1 illustrates retractable treadmill desk 100. In one embodiment, retractable treadmill desk 100A-100D are shown with belt component (discussed more completely with respect to FIG. 10, reference 102) in a first position, such as may be utilized by user for exercising, and a desk surface positioned by a height adjustment assembly (discussed more completely with respect FIG. 10, references 112 and 110 respectively) in an extended position In another embodiment, treadmill desk 100A is shown in a top-down view. In another embodiment, treadmill desk 100B is shown in a front elevation. In another embodiment, treadmill desk 100C is shown in a side elevation. In another embodiment, treadmill desk 100D is shown in an perspective view.

Figure 2:
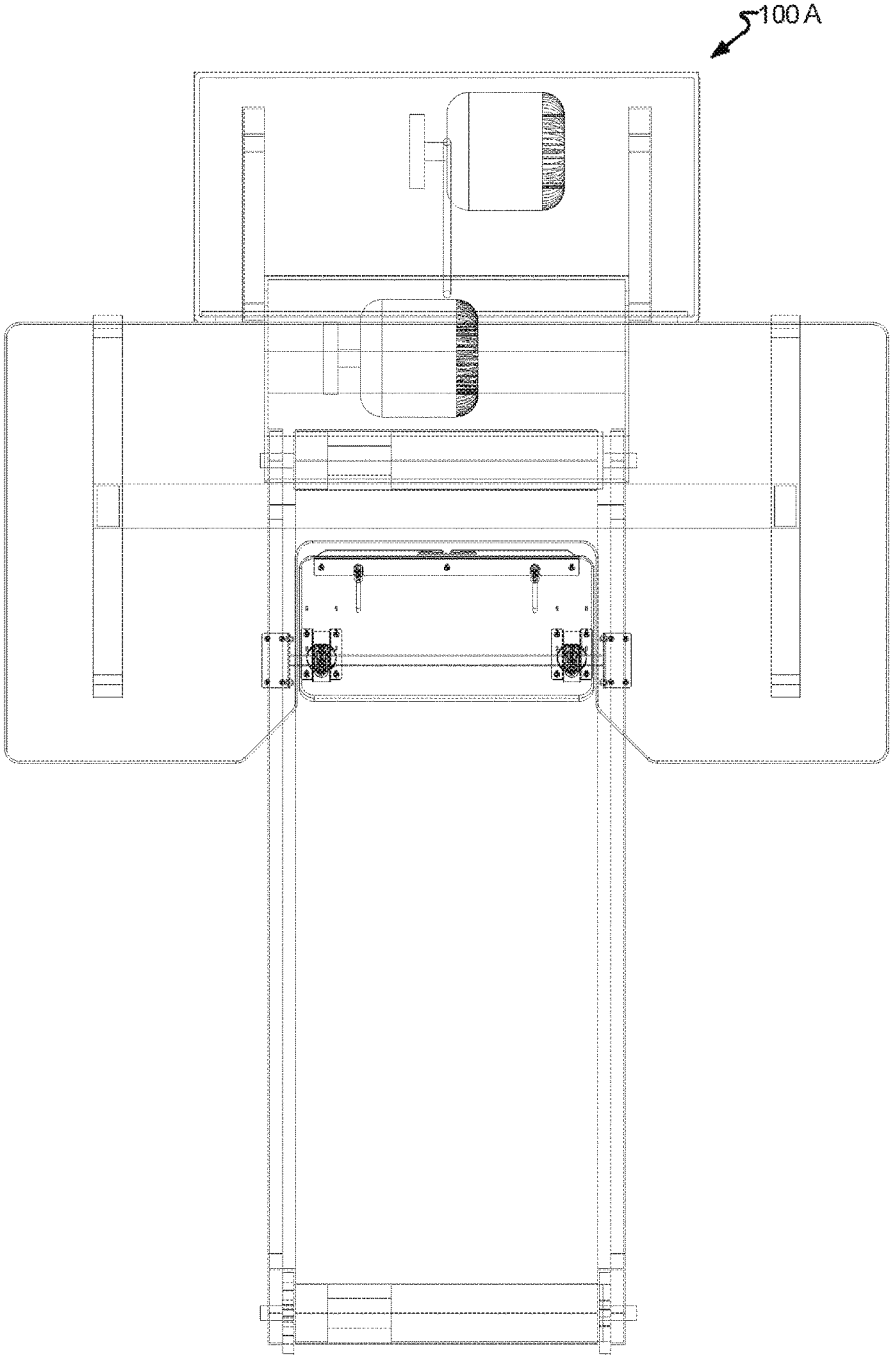
FIG. 2 illustrates one of the graphical projections of FIG. 1, with greater detail.

FIG. 2 illustrates another view of treadmill desk 100A.

Figure 3:
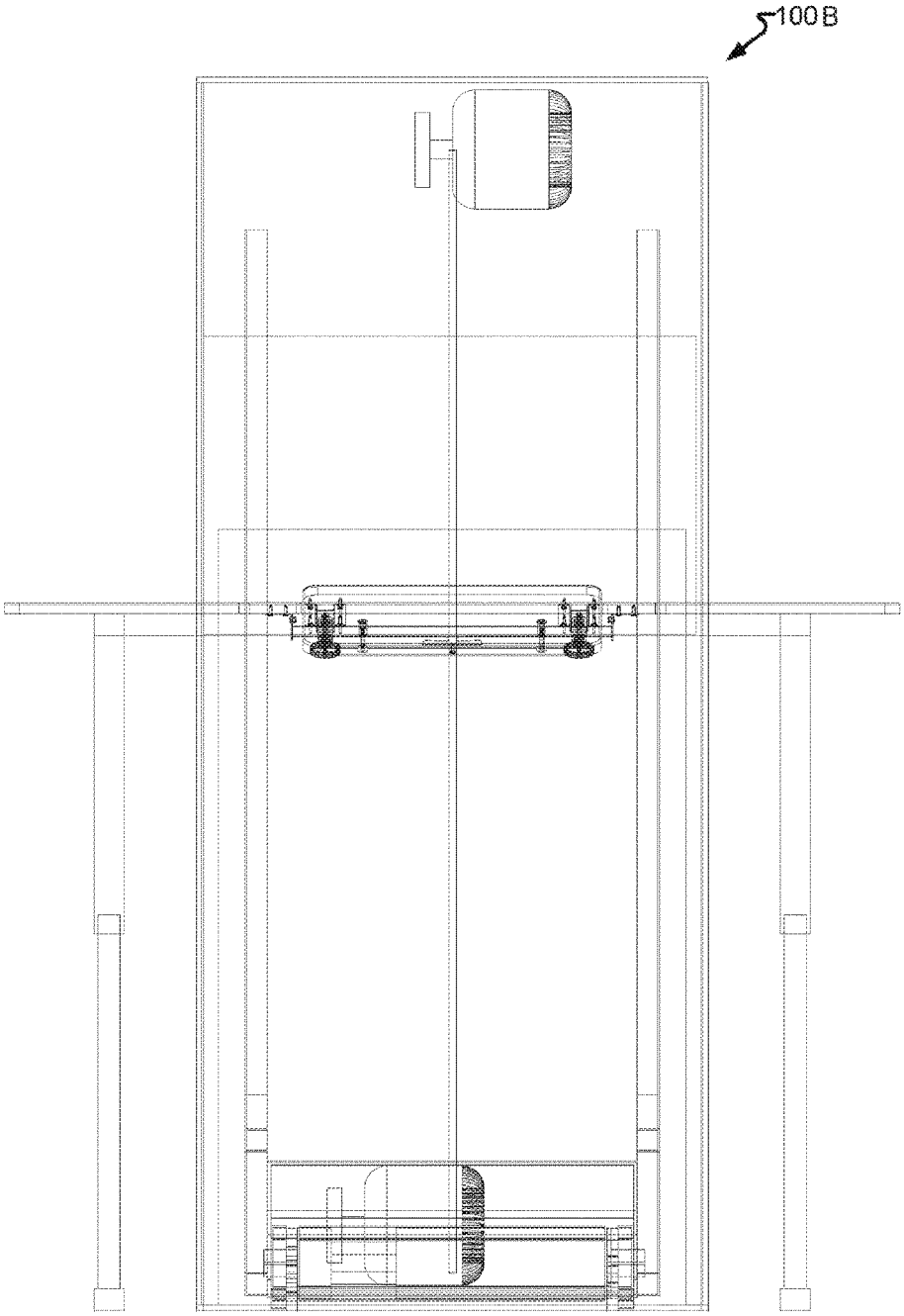
FIG. 3 illustrates one of the graphical projections of FIG. 1, with greater detail.

FIG. 3 illustrates another view of treadmill desk 100B.

Figure 4:
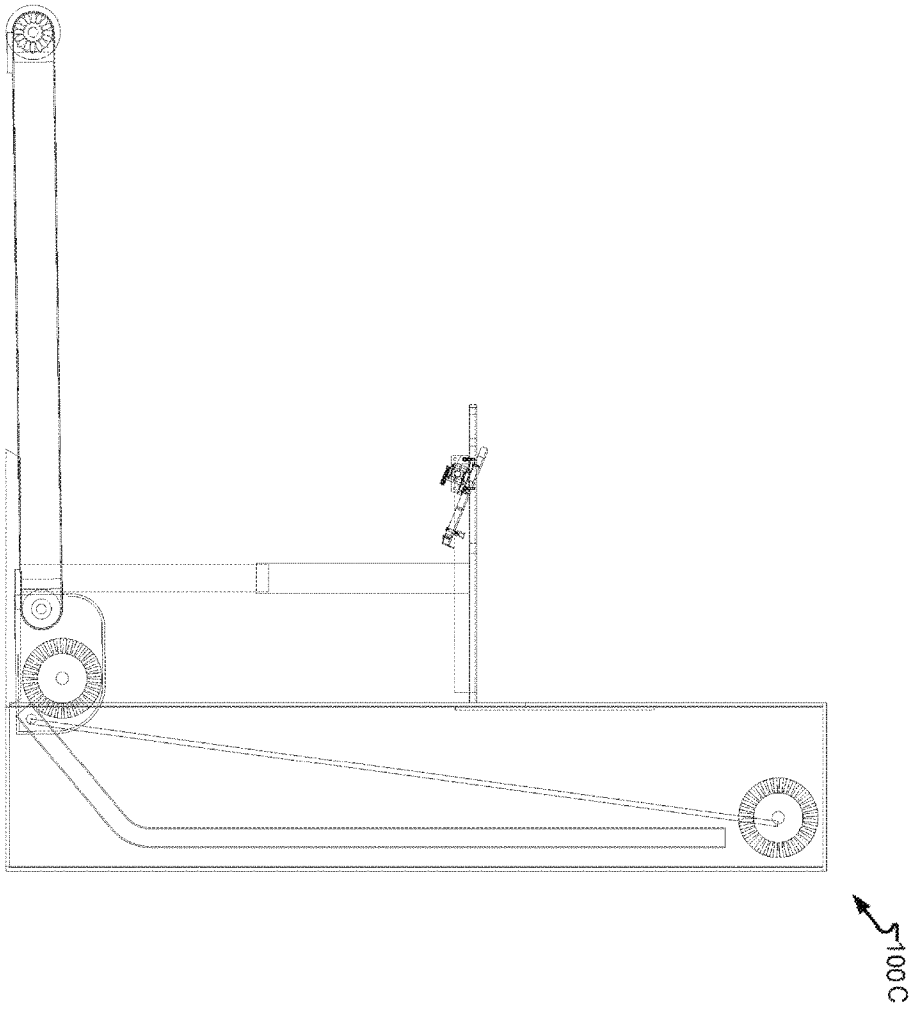
FIG. 4 illustrates one of the graphical projections of FIG. 1, with greater detail.

FIG. 4 illustrates another view of treadmill desk 100C.

Figure 5:
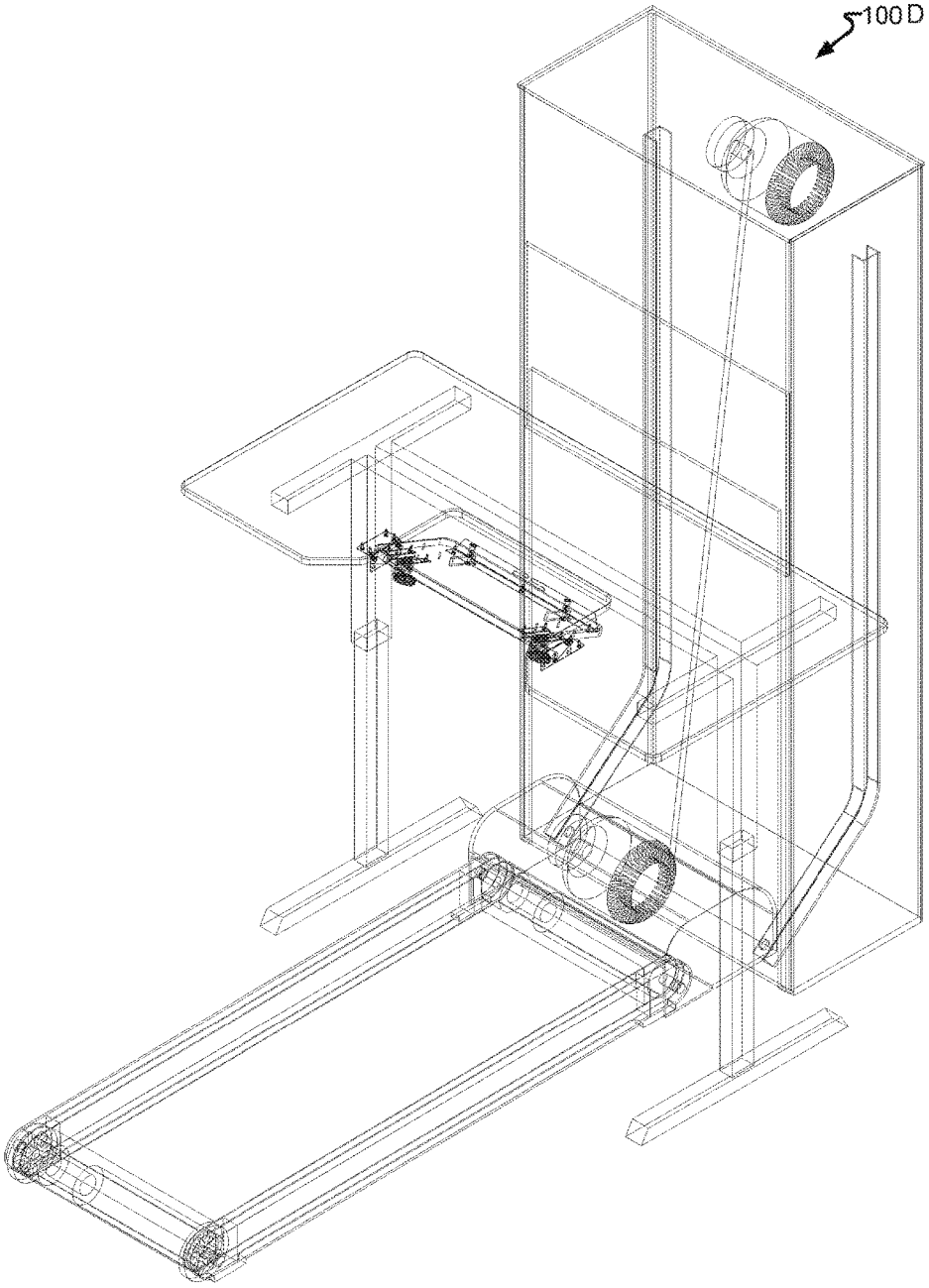
FIG. 5 illustrates one of the graphical projections of FIG. 1, with greater detail.

FIG. 5 illustrates another view of treadmill desk 100D.

Figure 6:
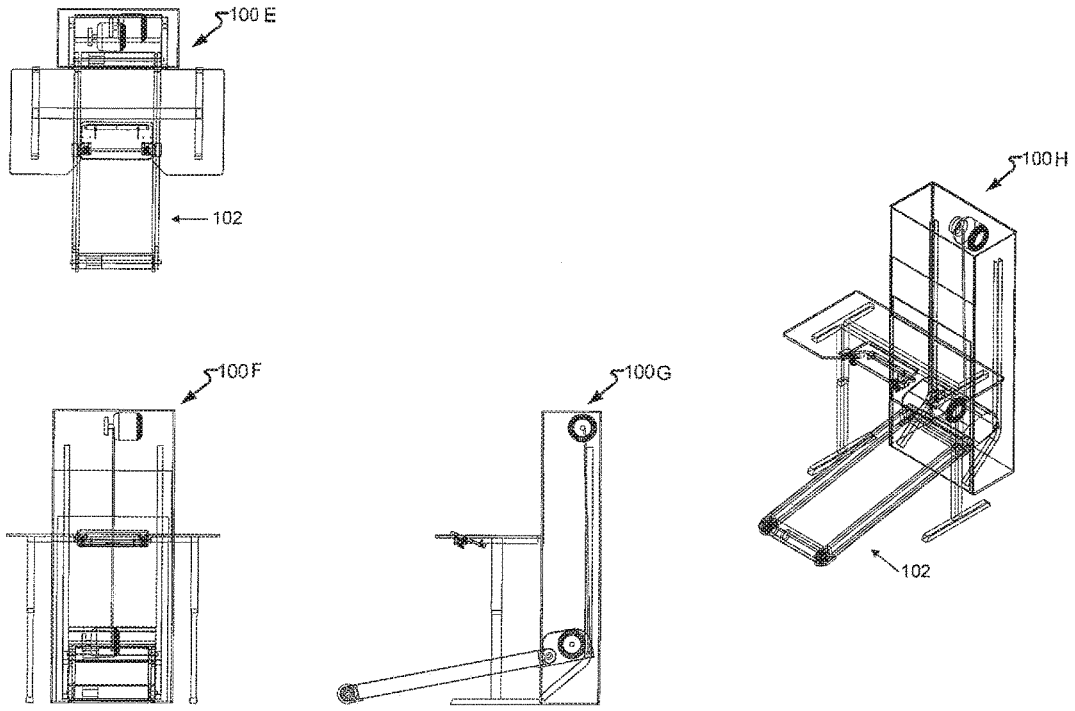
FIG. 6 illustrates the retractable treadmill desk of FIG. 1, with the treadmill partially retracted.

FIG. 6 illustrates retractable treadmill desk 100 as retractable treadmill desk 100E-100H with belt component 102 in a first intermediate position between a first position and a second position. In one embodiment, retractable treadmill desk 100E is shown in a top-down view. In another embodiment, treadmill desk 100F is shown in a front elevation. In another embodiment, treadmill desk 100G is shown in a side elevation. In another embodiment, treadmill desk 100H is shown in an perspective view.

Figure 7:
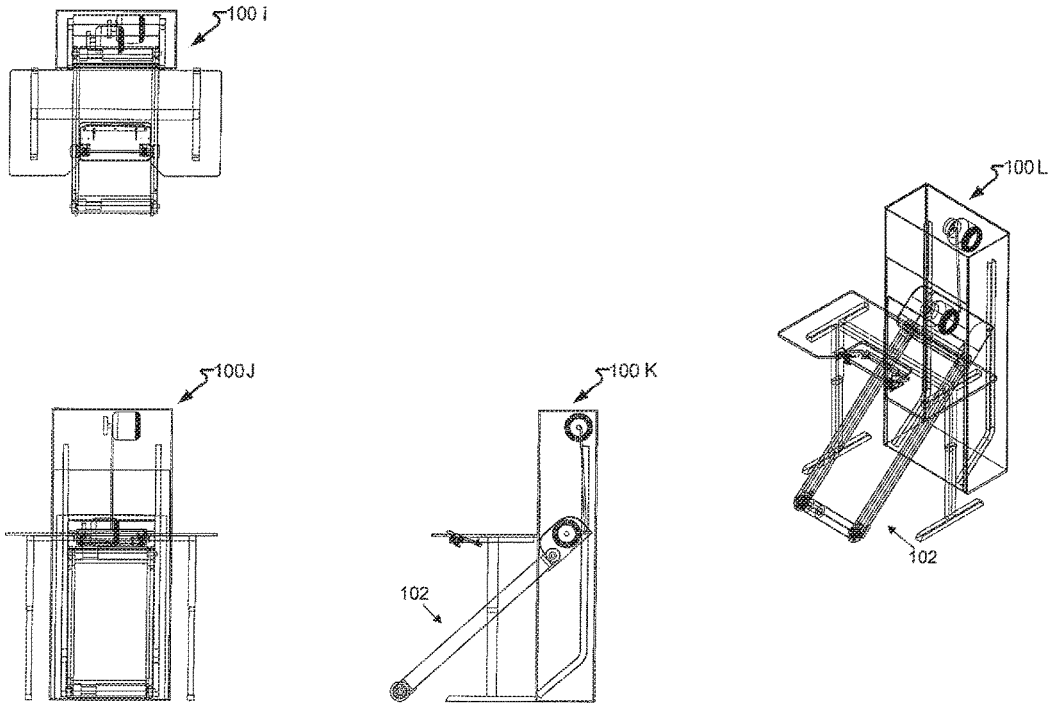
FIG. 7 illustrates the retractable treadmill desk of FIG. 1, with the treadmill partially retracted.

FIG. 7 illustrates retractable treadmill desk 100 as retractable treadmill desk 100*i*-100L with belt component 102 in a second intermediate position between a first position and a second position. In one embodiment, retractable treadmill desk 100*i* (lower case "i" is utilized to avoid potential confusion that may result from upper case "I" being misinterpreted as the numeral one) is shown in a top-down view. In another embodiment, treadmill desk 100J is shown in a front elevation. In another embodiment, treadmill desk 100K is shown in a side elevation. In another embodiment, treadmill desk 100L is shown in an perspective view.

Figure 8:
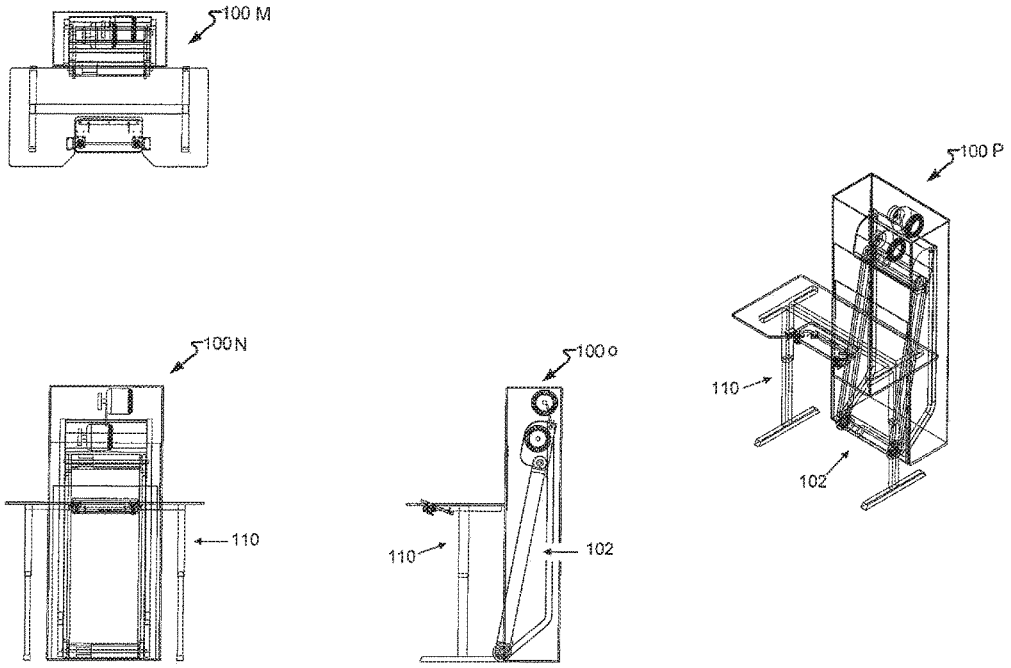
FIG. 8 illustrates the retractable treadmill desk of FIG. 1, with the treadmill partially or fully retracted.

FIG. 8 illustrates retractable treadmill desk 100 as retractable treadmill desk 100M-100P with belt component 102 in a second intermediate position between a first position and a second position. In one embodiment, retractable treadmill desk 100M is shown in a top-down view. In another embodiment, treadmill desk 100N is shown in a front elevation. In another embodiment, treadmill desk 100*o* (lower case "o" is utilized to avoid potential confusion that may result from upper case "0" being misinterpreted as the numeral zero) is shown in a side elevation. In another embodiment, treadmill desk 100P is shown in an perspective view.

Figure 9:
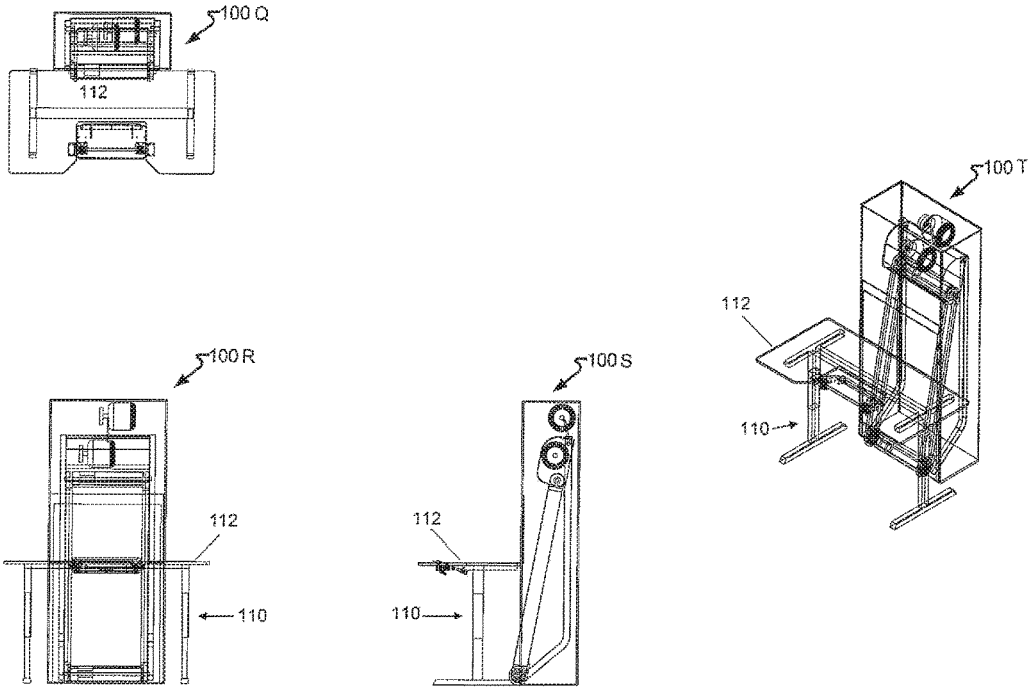
FIG. 9 illustrates the retractable treadmill desk of FIG. 1, with the treadmill partially or fully retracted and with the desk reduced in height.

FIG. 9 illustrates retractable treadmill desk 100 as retractable treadmill desk 100Q-100T with belt component 102 in a second position and desk surface 112 positioned by height adjustment assembly 110 at a second height less than a fully extended height. In one embodiment, retractable treadmill desk 100Q is shown in a top-down view. In another embodiment, treadmill desk 100R is shown in a front elevation. In another embodiment, treadmill desk 100S is shown in a side elevation. In another embodiment, treadmill desk 100T is shown in an perspective view.

Figure 10:
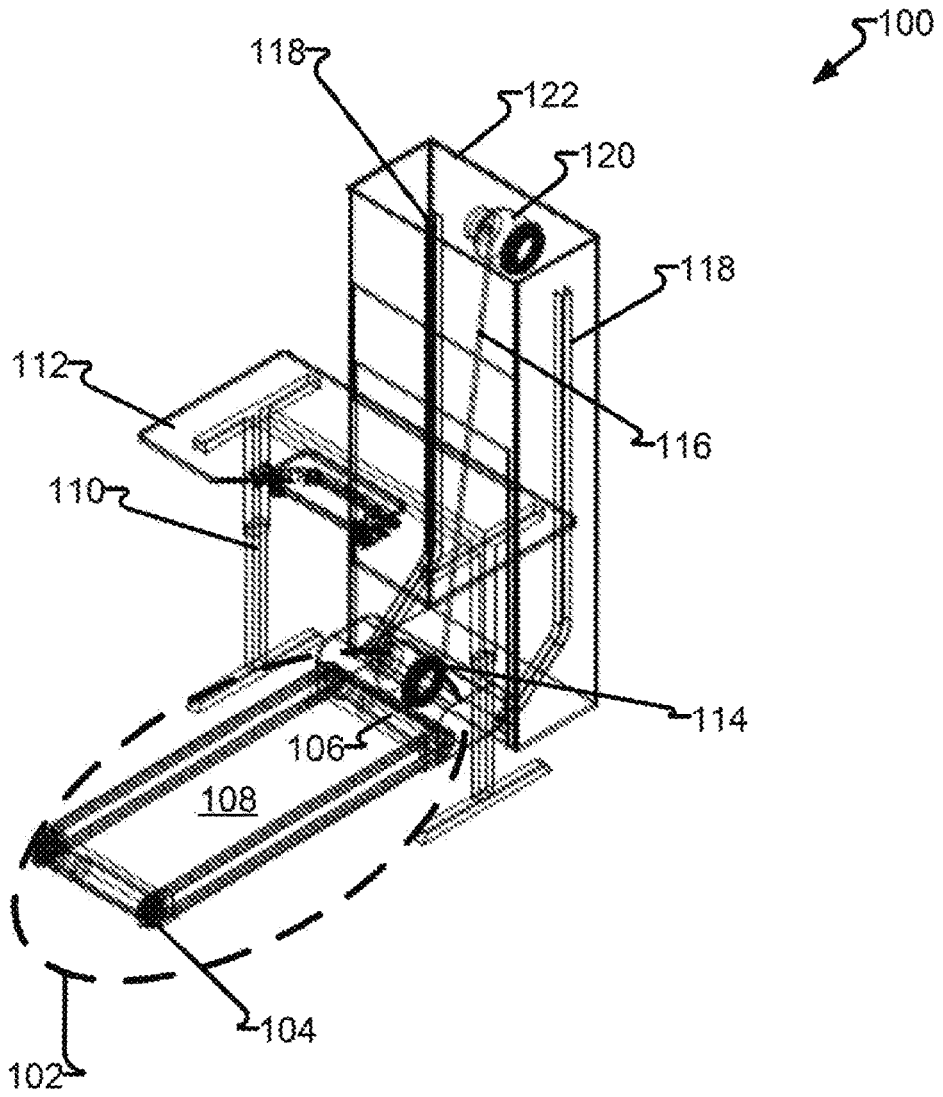
FIG. 10 illustrates the retractable treadmill desk of FIG. 1.

FIG. 10 illustrates retractable treadmill desk 100. In one embodiment, belt component 102 comprises belt 108 tensioned between first roller 106 and second roller 104. First motor 114 operates belt 108 such as to control the speed of belt 108 for use in walking, jogging, running, or similar exercise by a user thereon. Desk surface 112 is maintained on height adjustment assembly 110 to facilitate use by the user such as by holding a keyboard, writing papers, reading materials, electronics, etc. in a manner conducive to usability by the user.

FIG. 10 illustrates retractable treadmill desk 100 in a first position, showing belt 108 substantially parallel to a floor or other structure on which retractable treadmill desk 100 may be placed. Transitioning retractable treadmill desk 100 to a second position, such as illustrated by FIGS. 3, 8, and 9, allows for retractable treadmill desk 100, and more particularly desk surface 112, to be utilized by a user standing on the floor without standing or otherwise interacting with belt component 102. Belt component 102 may be placed in an intermediate position between the first position and the second position (see FIG. 6) such as to provide an incline to belt component 102 and thereby alter the degree of exertion provided to the user.

As discussed above, first motor 114 may both operate belt 108 and transition belt component 102 between the first position and second position. In another embodiment, second motor 120 performs the transition of belt component 102 between the first position and second position. In one embodiment, first motor 114 selectively engages cable 116 to apply a force to the interior of cabinet 122. Alternatively, first motor 114 may selectively engage cable 116 to apply a force to another portion of belt component 102 via a pulley attached to treadmill desk 100. It should be appreciated that the transition between the first position and the second position may be from the first position to the second position, from the second position to the first position, or to/from or towards/away the first or second position from an intermediate position.

In another embodiment, track 118 engages guides, wheels, or other attachments to belt component 102 to direct belt component 102 during the transitions and to maintain belt component 102 relative to track 118 and optionally to cabinet 122.

Figure 11:
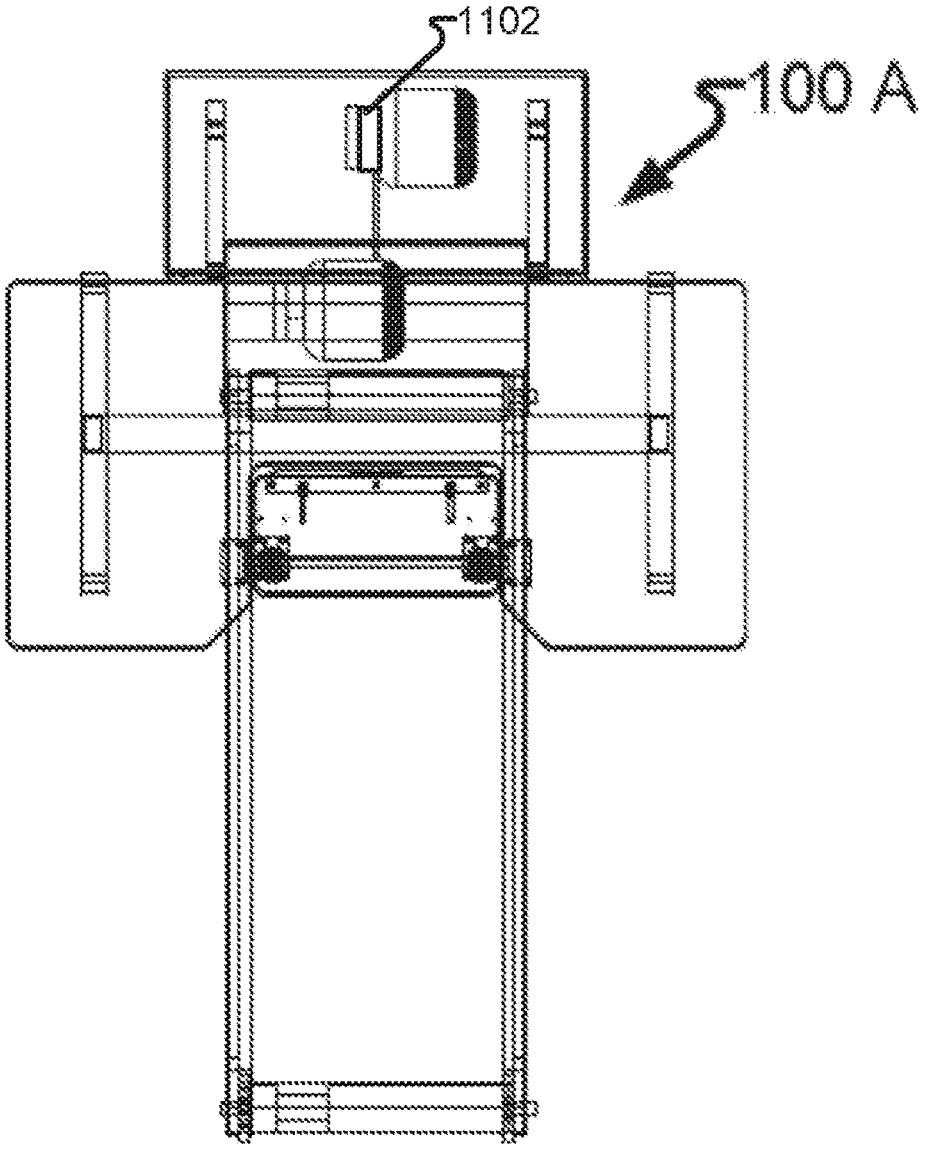
FIG. 11 illustrates an inertial reel as one component of the retractable treadmill desk of FIG. 1.

FIG. 11 illustrates retractable treadmill desk 100A. In one embodiment, retractable treadmill desk 100A comprising inertial reel 1202.

Figure 12:
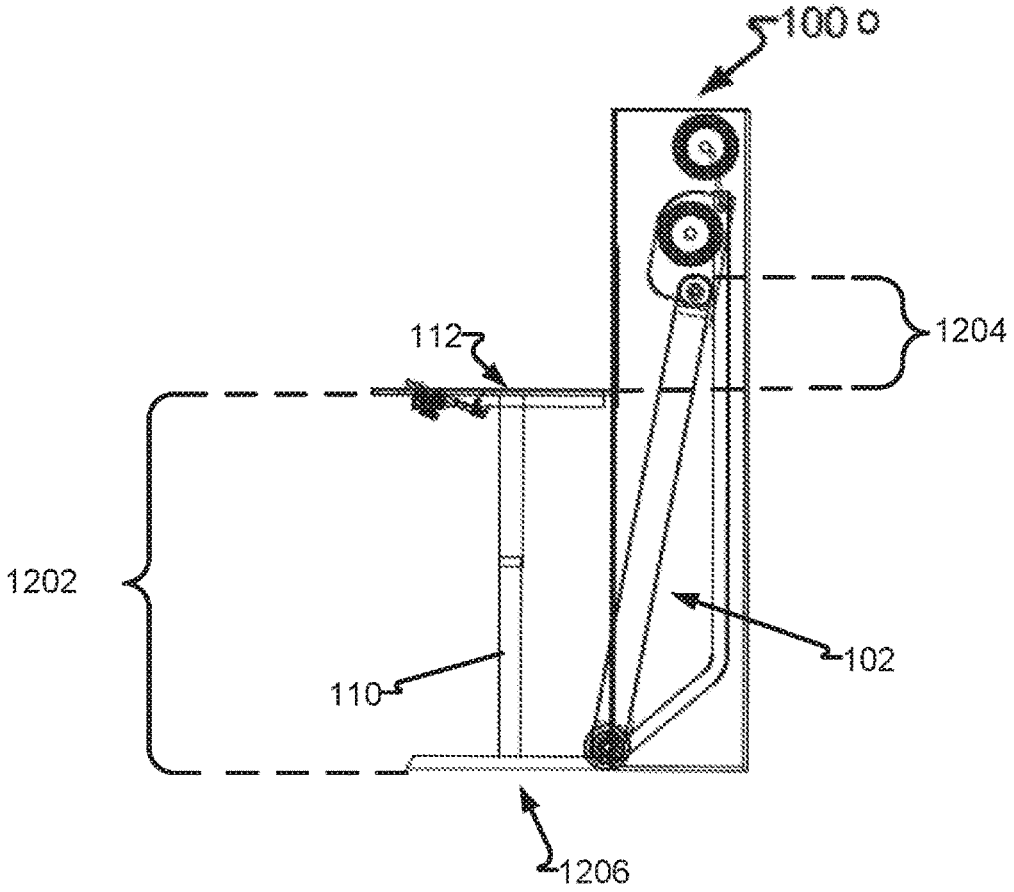
FIG. 12 illustrates details of the retractable treadmill desk of FIG. 1.

FIG. 12 illustrates retractable treadmill desk 100*o*. In one embodiment, adjustable height assembly 110 is in an extended position such that desk surface 112 is at height 1202 defined as the distance from surface 1206 supporting retractable treadmill desk 100*o* to the height of desk surface 112. Retractable treadmill desk 100*o* comprises belt component 102 is a height 1204 which is a positive distance vertically above desk surface 112. The overall vertical height of belt component 102, when in the second position, is the combination of height 1202 with height 1204.

The invention claimed is:

1. A retractable treadmill, comprising:

a belt component comprising a belt and a first motor operable to control a speed of the belt tensioned between a first roller and a second roller and wherein the first motor is proximate to the first roller and distal to the second roller;

a frame comprising a track operable to maintain and restrict the belt component in a first position, a second position, and intermediate positions between the first position and the second position;

a desk comprising a desk surface;

wherein the track is operable to guide the belt component as the belt component transitions between, and including, the first position and the second position;

wherein the belt component is operable to accommodate a user thereon for the purposes of exercising while in the first position;

wherein at least a portion of the belt component, proximate to the first roller and distal to the second roller, extends vertically above the desk surface when in the second position;

wherein the belt component is maintained in a substantially vertical position when in the second position; and a second motor selectively applying a force to the belt component to cause the belt component to transition between the first position and the second position.

2. The retractable treadmill of claim 1, further comprising a cable selectively engaged with the second motor and, when engaged, the cable receives the force from the second motor to cause the belt component to transition between the first position and the second position.

3. The retractable treadmill of claim 2, wherein the cable is attached to the belt component and engages a pulley attached to the frame.

4. The retractable treadmill of claim 1, wherein the desk surface accommodates utilization by the user engaged in exercising when the belt component is in the first position.

5. The retractable treadmill of claim 4, wherein the desk surface further accommodates utilization by the user when the belt component is in the second position.

6. The retractable treadmill of claim 1, wherein the desk comprises a height-adjustment assembly to selectively elevate the desk surface.

7. The retractable treadmill of claim 6, wherein transitioning the belt component between the first position and the second position comprises energizing the height-adjustment assembly to position the desk surface to a non-blocking position that would otherwise obstruct the transition of the belt component between the first position and the second position.

8. The retractable treadmill of claim 6, wherein the height-adjustment assembly is physically attached to the frame.

9. The retractable treadmill of claim 1, wherein the transition between the first position and the second position is maintained to obtain an incline angle of the belt component.

10. The retractable treadmill of claim 1, further comprising a guide, attached to the belt component, to engage the track along the transition between the first position and the second position.

11. The retractable treadmill of claim 1, further comprising an automatic latch to engage the belt component upon completing the transition from the first position to the second position.

12. The retractable treadmill of claim 1, further comprising an inertial reel attached to the belt component to limit a rate of travel from the second position to the first position.

13. The retractable treadmill of claim 1, wherein the second motor comprises an actuator.

14. The retractable treadmill of claim 1, wherein the track causes the belt component, when transitioning from the first position to the second position, to cause the first roller of the belt component to become positioned into the interior of the frame.

15. The retractable treadmill of claim 1, wherein the track causes the belt component, in the second position, to be substantially maintained within the interior of the frame.

16. A method, comprising:

operating a belt of a belt component, by a first motor, to control a speed of the belt, the belt being disposed between a first roller and a second roller and wherein the first motor is proximate to the first roller and distal to the second roller;

selectively maintaining the belt component in a first position, a second position, and positions therebetween the first position and the second position by a frame comprising a track engaging a portion of the belt component;

positioning a desk surface a first distance from a supporting interface utilized to engage a surface for supporting the desk; and wherein at least a portion of the belt component, proximate to the first roller and distal to the second roller, extends vertically above the desk surface when in the second position;

wherein the belt component is operable to accommodate a user thereon for the purposes of exercising while in the first position;

wherein the belt component is maintained in a substantially vertical position when in the second position; and retracting the belt component to the interior of the frame by a second motor selectively applying a force to the belt component to cause the belt component to transition from the first position to the second position.

17. The method of claim 16, wherein the second motor comprises an actuator.

18. The method of claim 16, wherein retracting further comprises automatically raising the desk surface attached to the frame to reposition the desk surface from a blocking position that would, absent being raised, obstruct the transition of the belt component.

19. The method of claim 16, further comprising, deploying the belt component from the interior of the frame by the second motor to cause the belt component to transition from the second position to the first position.

20. A system, comprising:

means for operating a belt, of a belt component, to control a speed of the belt, the belt being disposed between a first roller and a second roller and wherein the means for operating the belt are proximate to the first roller and distal to the second roller;

means for selectively maintaining the belt component in a first position, second position, and positions therebetween the first position and the second position by a frame comprising a track engaging a portion of the belt component;

means for providing a desk with a desk surface;

wherein the means for operating the belt component further comprise means for accommodating a user thereon for the purposes of exercising while in the first position;

wherein the means for operating the belt component further comprise means for maintaining the belt component in a substantially vertical position when in the second position;

means for positioning at least a portion of the belt component, proximate to the first roller and distal to the second roller, vertically above the desk surface when in the second position; and means for positioning the belt component along a path, the path bounded by the first position and the second position.

* * * * *